137-13 SR
6/17/80 XR 4,208,251

United States Patent [19]
Rasmussen
[11] 4,208,251
[45] Jun. 17, 1980

[54] PROCESS AND APPARATUS FOR PRODUCING NONAQUEOUS COKE SLURRY AND PIPELINE TRANSPORT THEREOF

[76] Inventor: Ross H. Rasmussen, R.F.D. #2, Hooper, Nebr. 68031

[21] Appl. No.: 916,514

[22] Filed: Jun. 19, 1978

[51] Int. Cl.[2] ..... C10B 47/18; F17D 1/00

[52] U.S. Cl. ..... 201/14; 44/51; 137/13; 201/32; 202/117; 202/133; 202/150; 202/118; 208/8 R; 208/370; 406/47; 432/13

[58] Field of Search ..... 201/14, 32, 41, 45, 201/3, 39, 29, 30; 44/51; 302/14, 66; 208/8 R, 370; 137/13; 406/47, 48, 197; 202/117, 118, 133, 150; 110/229, 230; 432/13

[56] References Cited

U.S. PATENT DOCUMENTS

| | | | |
|---|---|---|---|
| 596,468 | 1/1898 | Bell | 302/66 |
| 1,950,017 | 3/1934 | Zwoyer et al. | 201/32 X |
| 3,129,164 | 4/1964 | Cameron | 208/370 X |
| 3,167,487 | 1/1965 | Mansfield | 201/32 X |
| 3,432,209 | 3/1969 | Scott | 302/14 X |
| 3,527,692 | 9/1970 | Titus | 302/66 X |
| 3,869,350 | 3/1975 | Goossens et al. | 201/32 |
| 3,907,134 | 9/1975 | Metzger | 302/14 X |
| 3,968,999 | 7/1976 | Keller | 302/14 X |
| 3,976,548 | 8/1976 | Kevorhian et al. | 202/118 |
| 4,014,661 | 3/1977 | Hess et al. | 44/51 |
| 4,045,092 | 8/1977 | Keller | 137/13 X |
| 4,058,205 | 11/1977 | Reed, Jr. | 201/14 X |
| 4,121,995 | 10/1978 | Hsu | 302/66 X |
| 4,127,391 | 11/1978 | Koppelman | 44/51 |

*Primary Examiner*—Joseph Scovronek
*Assistant Examiner*—Roger F. Phillips
*Attorney, Agent, or Firm*—Merriam, Marshall & Bicknell

[57] ABSTRACT

A process comprising heating coal in a substantially air-free environment to liberate volatile materials and produce coke, condensing at least some of the volatile materials so liberated to liquefied products and dispersing the coke therein to form a coke slurry, feeding the coke slurry to a slurry pipeline, and pumping the coke slurry through the pipeline to a destination.

Apparatus comprising a tube furnace having an external heating means for indirectly heating powdered coal therein in a substantially air-free environment to a temperature adequate to liberate volatile materials and produce coke, means to feed powdered coal to the furnace under pressure and force the volatile materials and coke produced in the furnace through the furnace to a condensing means in which at least some of the volatile materials are condensed with the coke dispersed therein to form a coke slurry, and means to convey the coke slurry from the condensing means to a pipeline for transport to a destination.

15 Claims, 2 Drawing Figures

Figure 1:
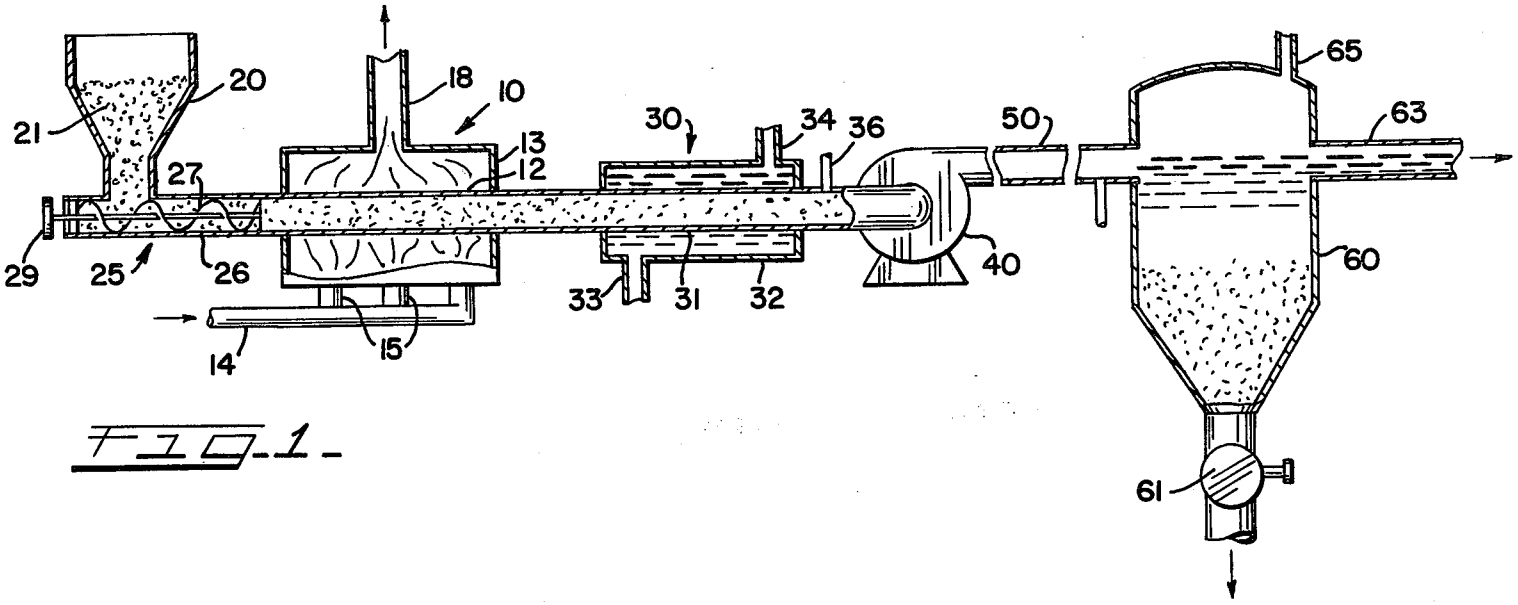

PROCESS AND APPARATUS FOR PRODUCING NONAQUEOUS COKE SLURRY AND PIPELINE TRANSPORT THEREOF

This invention relates to apparatus and methods of producing and transporting useful fuels and chemicals. More particularly, this invention is concerned with methods and apparatus for converting coal to coke and transporting a slurry of the coke in liquid by-products of the coking in a pipeline to a destination.

Coal is a widely used fuel in the generation of electricity, in industrial operations and the production of chemicals. Coal is widely distributed naturally, but still it is very often mined far from the ultimate user, thereby requiring that it be transported over long distances. Railroad transportation of coal in large quantities by means of unit trains is now widely employed but is more costly than desired.

It has been known for many years that powdered coal can be transported as an aqueous slurry by means of a pipeline. This method is now commercially exploited in about three pipelines. The method is presently undergoing substantial additional interest consistent with the increased intention to substitute coal for natural gas and oil as the energy source for electricity generation and industrial energy needs.

Although an aqueous coal slurry pipeline can be installed with relatively little adverse affect on the environment, there is great concern that the amount of fresh water used in the slurry will severely and detrimentally affect the environment where the pipeline begins and terminates. The large amount of coal which a pipeline would be expected to transport to be economically justifiable would require the availability and use of very large amounts of water, whether from surface or well sources, since an aqueous coal slurry is generally about 50% water by volume. The intended withdrawal of surface and well water for a coal slurry pipeline undoubtedly would be opposed by those who have other needs and uses for the water, such as farmers, cities, industries and naturalists. Furthermore, once the slurry reaches its destination, the coal must be separated from the water. The separated water, however, most likely will be unpotable because of dissolved or suspended organic materials. The water would thus require cleaning before it could be discharged to a stream or lake. Obviously, many inherent environmental problems would be involved in an aqueous coal slurry pipeline that would require extensive and expensive studies and testing, probably protracted litigation, and even action by the state and federal legislative bodies to write new laws. It is contemplated, however, that many of the potential environmental problems involved in an aqueous coal slurry pipeline could be eliminated by avoiding the use of water.

One way to avoid use of water as the suspending liquid for the coal is to replace the water by some other suitable liquid. Oil could be used as the carrier liquid but unfortunately it is not generally available reasonably near the coal mines in the quantity needed to suspend the volume of coal intended to be transported by the pipeline. Transporting oil to the beginning of the pipeline would be costly in many cases so that this approach is not a likely solution except in special situations.

From the above it is clear that a need exists for an alternative means by which the energy available in coal can be transported from the mines to a suitable destination for use as desired.

According to one aspect of the subject invention there is provided a process which comprises heating coal in a substantially or essentially air-free environment to liberate volatile materials and produce coke, condensing at least some of the volatile materials to liquefied products and dispersing the coke therein to form a coke slurry, feeding the coke slurry to a slurry pipeline, and pumping the coke slurry through the pipeline to a destination. The described process avoids the use of water as the carrier and thus circumvents the environmental problems inherent in its use. By generating its own carrier liquid, the process at least substantially reduces reliance on liquid carriers from other sources, although at times it may be desirable to supplement the liquids obtained from the coking operation with one or more liquid not obtained in situ from the coking operation. The supplemental liquids may be obtained, for example, from a petroleum source, or from a prior coking operation.

The coking operation can be readily effected at any suitable temperature but generally it can be effected at a temperature in the range of about 932° to 1382° F. (500°–750° C.), which is the range considered suitable for low-temperature carbonization of coal. More specifically, a range of 600° to 900° F. is recommended for carrying out the process.

To facilitate recovery and condensation of the volatile materials released in the coking operation, it is advisable to effect both the coking and volatile material condensation steps at an increased pressure, and generally at a pressure of at least 15 psig.

More than enough materials which are liquid at atmospheric or slightly higher pressure volatilize in the coking step so that upon subsequent cooling and condensation a liquid carrier, which may also contain gas, is obtained in an amount sufficient to suspend therein the coke from which it is obtained. Cooling and condensation can be effected by any suitable means such as a conventional condenser using a liquid such as water as the coolant, or an apparatus which uses incoming powdered coal as the coolant. Furthermore, the pipeline itself may function as a condenser if it is so positioned, such as in air, to effect heat dissipation.

About 40 to 50% by weight of the coal is converted to gases and liquids. One or more suitable emulsifying agents can be added to the resulting slurry as may be required to keep the coal particles suspended and to emulsify the higher boiling tars in the lower boiling liquids released from the coal. Gases which are not condensed to liquids remain in the slurry and lead to some foam formation which further helps to keep the coke particles in suspension.

The described process is intended to be operated on a continuous, rather than a batch, basis from the time the coal is fed to the furnace until the coke slurry has been pumped through the pipeline and reaches the intended destination.

Following pumping of the coke slurry through the pipeline to a destination, the coke can be separated from the liquid carrier by settling, distillation or filtering. The coke can be washed with a solvent such as benzene to remove residual tars and the like if it is desired to obtain a more highly pure product. The coke can be used as a fuel in electric generating plants or in industrial operations. The liquid carrier can be processed in conventional ways to isolate useful chemical products of the types previously isolated from coal tars. It is, of course, feasible to use the entire coal slurry as a fuel without separating the coke from the liquid carrier.

According to a further aspect of the invention there is provided a novel apparatus particularly suitable for practicing the described process. The apparatus comprises a furnace for indirectly heating powdered coal therein in a substantially air-free environment to a temperature adequate to liberate volatile materials and produce coke, means to feed powdered coal to the furnace, means to move the volatile materials and coke produced in the furnace through the furnace to a condensing means in which at least some of the volatile materials are condensed with the coke dispersed therein to form a coke slurry, and means to convey the coke slurry from the condensing means to a pipeline for transport to a destination. An external heating means is desirably used to heat the coal.

The recommended means to feed the powdered coal to the furnace is a power auger. An auger can furnish the force needed to move first the coal and then the coke and volatile materials through the furnace, and then the coke slurry through the condensing means, desirably on a continuous basis. It also provides a seal against back flow of gases and liquids. A power auger also provides a means by which coal can be fed under pressure continuously to the furnace with easily controlled rates of feed. The residence time of the coal in the furnace is thus increased or decreased with ease as is appropriate.

The apparatus is advantageously provided with means to feed a supplemental liquid into the coke slurry in the event reduction of the coke slurry viscosity is desired. The same, or similar, means can be used to add an emulsifier or surfactant to the coke slurry to help maintain the coke particles in suspension and emulsify the various liquid products released from the coal.

The described process and apparatus is useful with soft and hard coals, lignite, low sulfur and high sulfur coals, and coals having low to high contents of volatiles which give freed liquid materials.

Figure 2:
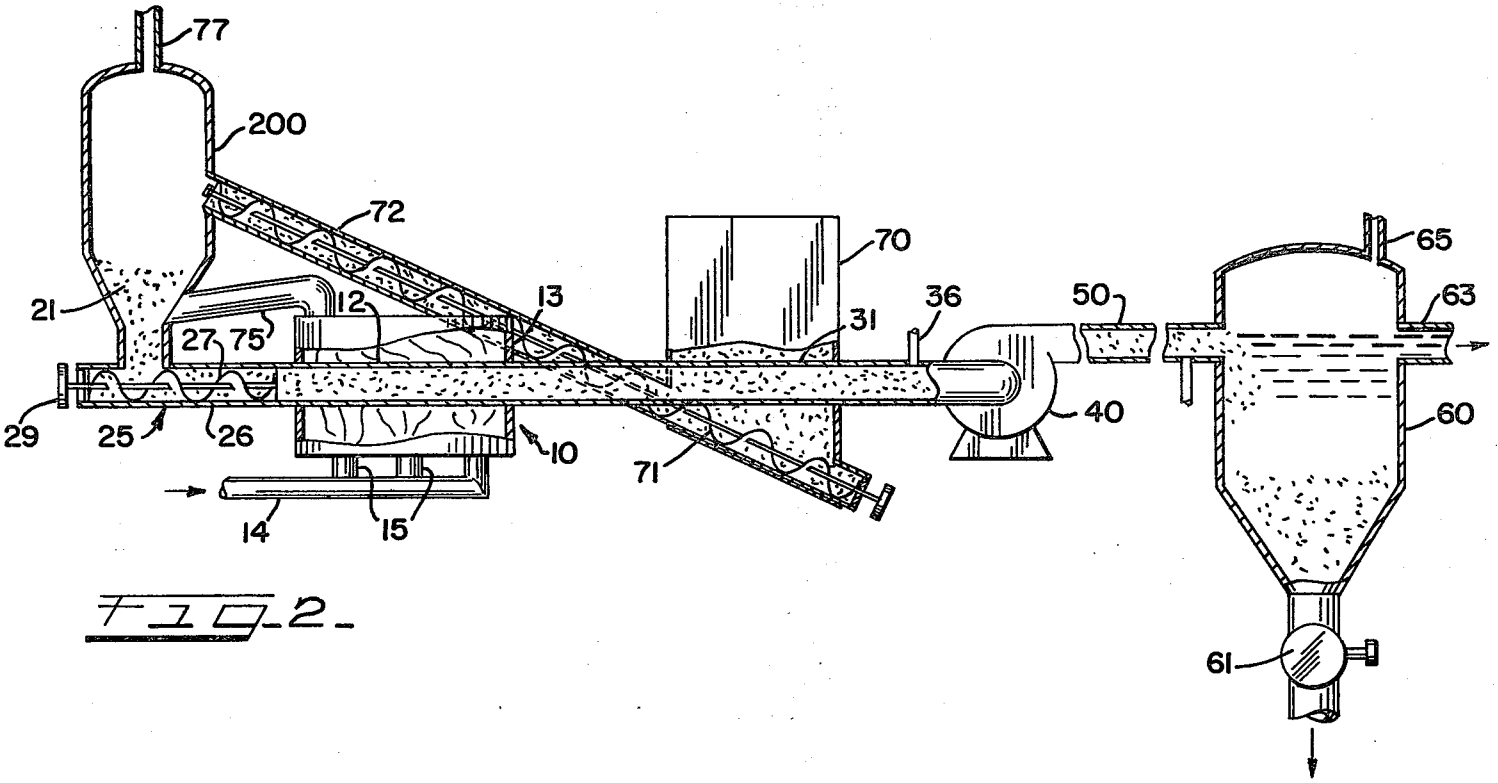

The invention will be described further in conjunction with the attached drawings, in which:

FIG. 1 is a schematic drawing illustrating apparatus for producing a coke slurry and delivering it to a destination by pipeline, and FIG. 2 is similar to FIG. 1 but illustrates the use of coal to cool the slurry and furnace gas to further dry and preheat the coal.

So far as is practical, the same elements or parts which appear in the various views of the drawings will be identified by the same numbers.

With reference to FIG. 1 of the drawings, the tubular furnace 10 has a horizontally positioned tube 12 located in walled oven 13. Conduit 14 feeds hot gas into oven 13 through ports 15. The hot gases at about 900° F. flow around tube 12 thereby heating it and its contents of powdered coal to a suitable coking temperature. The gases are vented from oven 13 through conduit 18 which can feed the still hot gases to a suitable regenerator or heat exchanger to recover as much heat as possible before the gases are vented to the atmosphere. Any suitable flue such as natural gas, coal, coke or even the slurry produced according to this invention can be used to produce the hot gas fed into oven 13.

Powdered coal 21 is fed to hopper 20 which has an open bottom in communication with powdered auger 25. Auger 25 comprises screw 27 located in tube 26. Pulley 29 is used to rotatably drive screw 27 to advance the powdered coal through tube 26 into furnace tube 12. The tubes 26 and 12 are sized the same internally to facilitate movement of coal from one tube to the other. A pressure of about 15 psig is created on the coal in the furnace tube. The described system substantially excludes air from entering the furnace, with the only air entering it limited to air absorbed on the coal particles, entrapped in the coal particles or occupying the space between the coal particles. In this way, a substantially air-free environment is created inside of the furnace tube.

The coke and volatile materials released from the coal are fed from furnace 10 to condenser 30. Condenser 30 has a tube 31 in direct communication with furnace tube 12 so that the dispersion of coke particles in the volatile materials can be fed in a direct path from furnace tube 12 to condenser tube 31. Jacket 32 is positioned around tube 31 and cold water is fed to the jacket interior by means of inlet 33 and hot water is removed through outlet 34. In this way the volatile materials are cooled and condensed to complete formation of a liquid carrier in which the coke particles are suspended.

In the event it is found that the coke slurry is too viscous, a thinning solvent such as a light oil or other solvent can be fed to the slurry by means of pipe 36 as the slurry leaves condenser 30 on its way to pump 40. Pipe 36 can also be used to add a surfactant, emulsifier or dispersing agent to the slurry to further increase the slurry stability.

Pump 40 receives the coke slurry from tube 31 and feeds it to pipeline 50. Various pumping substations along the pipeline will be used to maintain a suitable flow rate through the pipeline.

Separator vessel 60 is shown in the drawing in communication with pipeline 50. Separator vessel 60 can be located at the pipeline destination or terminal. As the coke slurry is about to enter separator vessel 60 a suitable emulsion cracking and/or anti-dispersing agent can be added, if desired, to the coke slurry. The coke slurry then is fed into the separator vessel 60. The coke particles settle in the vessel 60 and are removed periodically through valve 61. The coke particles are obtained as a thick liquid or paste. Extraction with a suitable solvent such as benzene or distillation can be used to purify the coke particles and free them of coal tar and other related ingredients. The liquid carrier from the coke slurry can be drawn off from vessel 60 by conduit 63. Any gases freed in vessel 60 are removed through conduit 65 in the top of vessel 60.

FIG. 2 illustrates a second embodiment of the invention which is similar in a number of respects to the embodiment illustrated by FIG. 1. Only the differences in the FIG. 2 embodiment will therefore be described. As shown in FIG. 2, a powdered coal bin 70 has been positioned to surround tube 31. Fresh mined powdered coal is supplied to bin 70 to cool the coke slurry flowing through tube 31. Powered auger 71 communicates with the bottom of coal bin 70 and is positioned in pipe 72 which extends to hopper 200. In this way incoming coal is used to cool the coke slurry and to be partially preheated. Once the coal reaches hopper 200, it is further dried and heated by exhaust gas fed from furnace 10 by pipe 75 to the lower interior space of hopper 200. The gas flows upwardly through the coal and out vent pipe 77 which can deliver it elsewhere for further processing or use as is appropriate.

It is also within the scope of the invention to send some of the liquid separated at the pipeline terminal back to the beginning of the pipeline for reuse. The liquid can be returned by a parallel pipeline or by railroad.

It is expected that more than one coking furnace will be needed to produce enough coke slurry to continuously operate the slurry pipeline. Accordingly, two or more of the coking furnaces can be operated in parallel with a common discharge and their total output fed to a single slurry pipeline.

The described invention should permit more ready pumping of the slurry than a coal-in-water slurry since the coal oils and liquids would have lower frictional resistance in a pipeline. The coke will also be better suspended in the slurry of this invention than would coal in an aqueous slurry so that pipeline pumping costs should be lower using the novel system of this invention. Furthermore, coking under pressure should result in a conservation of energy compared to other coking methods.

This detailed description has been given for clearness of understanding only, and no unnecessary limitations should be understood therefrom, as modifications will be obvious to those skilled in the art.

What is claimed is:

1. A process comprising:

heating coal in a substantially air-free environment to liberate volatile materials and produce coke, condensing in the presence of the coke at least some of the volatile materials so liberated to liquefied products and dispersing the coke therein to form a coke slurry, feeding the coke slurry to a slurry pipeline, and pumping the coke slurry through the pipeline to a destination.

2. A process according to claim 1 in which liquefied products are separated from the coke slurry at the destination.

3. A process according to claim 1 in which a supplemental organic liquid from an exterior source is included in the coke slurry after it is formed to reduce the slurry viscosity.

4. A process according to claim 3 in which the organic liquid is light oil.

5. A process according to claim 1 in which the slurry, at the destination, is used substantially entirely as a fuel.

6. A process comprising:

heating powdered coal at a temperature of at least 600° F. in a substantially air-free environment to liberate volatile materials and produce coke enveloped by the volatile materials, condensing in the presence of the coke at least some of the volatile materials so liberated to liquefied products with the coke dispersed therein thereby forming a coke slurry, feeding the coke slurry to a slurry pipeline, and pumping the coke slurry through the pipeline to a destination.

7. A process according to claim 6 in which powdered coal is conveyed by a power auger to a tube furnace, the coal is moved through the tube furnace as it is heated and converted to coke and volatile materials, and at least some of the volatile materials are condensed in the presence of coke to liquefied products with the coke dispersed therein.

8. A process according to claim 7 in which liquefied products are separated from the coke slurry at the destination.

9. A process according to claim 6 in which the coal is heated at a pressure of at least 15 psig.

10. A process according to claim 7 in which the coal is continuously fed to the furnace and continuously moved through the furnace.

11. Apparatus comprising:

a tube furnace having an external heating means for indirectly heating powdered coal therein in a substantially air-free environment to a temperature adequate to liberate volatile materials and produce coke, condensing means in which at least some of the volatile materials are condensed with the coke dispersed therein to form a coke slurry, means to feed powdered coal to the furnace under pressure and force the volatile materials and coke produced in the furnace through the furnace to said condensing means, A pipeline for transport of said coke slurry to a destination, and means to convey the coke slurry from the condensing means to said pipeline.

12. Apparatus according to claim 11 in which the means to feed the powdered coal to the furnace is a power auger, and the auger furnishes the force to move the coal, coke and volatile materials through the furnace and the condensing means to the pipeline.

13. Apparatus according to claim 11 including means to feed a liquid into admixture with the coke slurry after it is formed to reduce its viscosity.

14. Apparatus comprising:

a furnace having means for indirectly heating powdered coal therein in a substantially air-free environment to a temperature adequate to liberate volatile materials and produce coke, condensing means in which at least some of the volatile materials are condensed with the coke dispersed therein to form a coke slurry, means to move the volatile material and coke produced in the furnace through the furnace to said condensing means a pipeline for transport of said coke slurry to a destination, and means to convey the coke slurry from the condensing means to said pipeline.

15. Apparatus according to claim 11 in which at least two tube furnaces are in parallel with a common discharge means.

* * * * *